US006926399B2

(12) United States Patent
Yoshizawa et al.

(10) Patent No.: US 6,926,399 B2
(45) Date of Patent: Aug. 9, 2005

(54) INKJET RECORDING METHOD AND INKJET RECORDING APPARATUS

(75) Inventors: Tomomi Yoshizawa, Hachioji (JP); Shuji Kida, Iruma (JP); Hiroshi Takeuchi, Tokyo (JP); Toyoaki Sugaya, Hachioji (JP)

(73) Assignee: Konica Corporation, Tokyo (JP)

( * ) Notice: Subject to any disclaimer, the term of this patent is extended or adjusted under 35 U.S.C. 154(b) by 56 days.

(21) Appl. No.: 10/622,901

(22) Filed: Jul. 17, 2003

(65) Prior Publication Data

US 2004/0017454 A1 Jan. 29, 2004

(30) Foreign Application Priority Data

Jul. 25, 2002 (JP) ..... 2002-216521

(51) Int. Cl.[7] ..... B41J 2/01
(52) U.S. Cl. ..... 347/102; 347/101
(58) Field of Search ..... 347/101, 102, 347/105, 96; 428/195, 32.1

(56) References Cited

U.S. PATENT DOCUMENTS

| | | | | |
|---|---|---|---|---|
| 5,893,018 A | * | 4/1999 | De Bock et al. | 399/302 |
| 6,688,741 B2 | * | 2/2004 | Nishikawa | 347/105 |
| 2002/0008747 A1 | * | 1/2002 | Kaga et al. | 347/102 |

FOREIGN PATENT DOCUMENTS

| | | |
|---|---|---|
| JP | 59-222381 | 12/1984 |
| JP | 11-208097 | 8/1999 |
| JP | 2000-203152 | 7/2000 |
| JP | 2000-2800603 | 10/2000 |
| JP | 2002-67295 | 3/2002 |
| JP | 2002-178623 | 6/2002 |

* cited by examiner

*Primary Examiner*—Manish S. Shah
(74) *Attorney, Agent, or Firm*—Frishauf, Holtz, Goodman & Chick, P.C.

(57) ABSTRACT

An inkjet recording method having the steps of: ejecting ink containing pigment, water and an organic solvent onto an image receiving medium, wherein the image receiving medium has a support member having a non-solvent-permeable resin layer, and an ink image receiving layer having a solvent absorbing layer containing inorganic fine particles and a binder, and a surface portion layer containing resin fine particles, an inorganic pigment and a binder; and conducting a heating and pressing treatment onto the image receiving medium. The heating and pressing treatment satisfies conditions of following expressions:

$$(T-T_G)\times t>2$$

$$(T-T_M)\times t<3$$

wherein, T represents a surface temperature (° C.) of the heating and pressing treatment; $T_G$ represents a glass transition temperature of the resin fine particles (° C.); t represents a time (second) of the treatment; and $T_M$ represents a melting temperature (° C.) of the non-solvent-permeable resin layer.

17 Claims, 1 Drawing Sheet

INKJET RECORDING METHOD AND INKJET RECORDING APPARATUS

BACKGROUND OF THE INVENTION

The present invention relates to an inkjet recording method and an inkjet recording apparatus.

1. Prior Art

Inkjet recording, in which fine droplets of ink are flown by means of various principles to be adhered on a recording medium and such as images and letters are recorded, has advantages of easiness of relatively high speed, low noise and multi-colored recording.

Further, higher image quality comparable to silver halide photography and a lower price of an apparatus in inkjet printing with dye ink, due to advances of technologies, are accelerating the pervasion.

A dye is soluble in a solvent and a dye molecule is colored in a molecular state or in a cluster state. Therefore, the absorption spectrum is sharp and exhibits a color of high purity and brightness due to similar environment of each molecule. Further, transparency is high and hue is bright because there is no particle property, and no generation of light scattering and light reflection.

However, on the other hand, since decrease of a number of molecules directly reflects a color density when molecules are destructed by such as a photochemical reaction, light fastness is poor. Inkjet recorded images are excellent in image quality, however, show significant deterioration of image quality by aging, and it is a present stage that no techniques exceeding silver salt photography in respect to image storage stability.

In contrast to dye ink, pigment ink that uses a pigment being excellent in light fastness as a colorant has been utilized, as ink for the purpose of requiring an image being tough against photo-fading. A pigment is insoluble in a solvent and a dye molecule forms a particle to contribute coloring in a state of being dispersed. Even when a molecule at the surface was destroyed by such as a photochemical reaction, apparent decrease of coloring strength was small to exhibit an excellent image storage stability, however, gloss was significantly decreased due to the effects of light scattering and light reflection caused by particles.

As a method to solve the above-described problem, a method, in which thermoplastic fine particles, basically comprised of a thermoplastic resin, are melt to be formed into a film on an ink receiving layer to provide water resistance and gloss, is disclosed in Japanese Patent Publication No. 2-31673.

However, in inkjet printers available on the market, improvement of an ink absorption property of a recording medium has been desired in accordance with increase of printing speed, increase of recording density and improvement of required image density for photographic tone images, and the above-described technique can be said insufficient in this respect.

Further, a technique in which pigment particles are migrated into a thermoplastic resin layer after recording with pigment ink containing no dispersant on a recording medium having an outermost layer comprised of a thermoplastic resin, is disclosed in JP-A No. 11-208097 (hereinafter, JP-A refers to Japanese Patent Publication Open to Public Inspection). After pigment ink is adhered on the surface of a recording material, pigment particles are present on the surface of a thermoplastic resin layer and a solvent component is absorbed by each layer constituting an image receiving medium.

Particularly, in a higher density portion, pigment particles are distributed densely on the surface of a recording material irrespective of the presence of a dispersant in pigment ink. Therefore, significant decrease of gloss was observed as described above.

Further, in JP-A No. 2000-203152, a proposal is disclosed to improve an ink absorption property by defining a particle diameter of thermoplastic resin fine particles utilized in an ink receiving layer to be not less than 1 $\mu$m, however, by such large particles, film formation by melting is not performed sufficiently, and only images having poor gloss can be obtained, in addition, it is also difficult to achieve ink absorption amount and speed similar to those of inorganic fine particles.

Further, in JP-A No. 2000-280603, an inkjet recording medium containing thermoplastic resin fine particles and colloidal silica of 30 weight % thereof is proposed, however, it can be said insufficient in a today's trend requiring higher printing speed.

Further, in the above-described each recording medium, it can hardly be said sufficient with respect to quality requiring both abrasion resistance and water resistance due to insufficient film formation of thermoplastic resin fine particles and insufficient minuteness of a film.

Further, in JP-A No. 2002-178623, an image forming method, in which graininess and image storage stability has been improved by including thermoplastic fine particles in a surface layer and being subjected to a heating and pressing treatment after recording with pigment ink, is disclosed, however, it cannot be said sufficient quality in the stage of recent years when further improvement of printing speed is required.

Further, in JP-A No. 2002-67295, an inkjet recording apparatus; which is provided with a head ejecting ink on an image receiving sheet comprised of an ink receiving layer containing thermoplastic resin fine particles on the surface layer and a solvent absorbing layer inside thereof, and a heating means, and having a heating and pressing time of from 0.1 to 2 seconds, a temperature of from 50 to 150° C. and a pressure of from $9.8\times10^4$ to $4.9\times10^6$ Pa; is disclosed. According to the method, it is said that an image having improved gloss can be obtained by making an ink receiving layer transparent, however, it is still not satisfactory in respect to gloss and abrasion resistance to require further improvement.

PROBLEMS TO BE SOLVED

The invention has been made in view of the above-described problems, and the object is to provide an inkjet recording method and an inkjet recording apparatus which are favorable in gloss and uniformity of gloss as well as excellent in abrasion resistance.

SUMMARY OF THE INVENTION

The above object of the invention can be achieved by the following constitutions.

1. An inkjet recording method having the steps of:

ejecting ink containing pigment, water and an organic solvent onto an image receiving medium, wherein the image receiving medium comprises;

a support member having a non-solvent-permeable resin layer, and an ink image receiving layer, which is provided on the support member, having laminated layers of a solvent absorbing layer containing inorganic fine particles and a binder, and a surface portion layer containing resin fine particles, an inorganic pigment and a binder; and conducting a heating and pressing treatment onto the image receiving medium by a heating and pressing device, wherein the heating and pressing treatment satisfies conditions of following expressions (1) and (2) at the same time.

$$(T-T_G)\times t>2 \quad \text{Expression (1)}$$

$$(T-T_M)\times t<3 \quad \text{Expression (2)}$$

wherein, T represents a surface temperature (° C.) of a member, which is arranged on the ink image receiving layer side of said heating and pressing device at the position where said heating and pressing treatment is performed, at said position; $T_G$ represents a glass transition temperature of said resin fine particles (° C.); t represents said heating and pressing time (second); and $T_M$ represents a melting temperature (° C.) of said resin layer.

2. The inkjet recording method described in item 1 described above, characterized in that said heating and pressing treatment satisfies conditions of following expressions (3) and (4) at the same time.

$$(T-T_G)\times t>6 \quad \text{Expression (3)}$$

$$(T-T_M)\times t<3 \quad \text{Expression (4)}$$

wherein, T, $T_G$, $T_M$, and t represent the same meanings as in expressions (1) and (2).

3. The inkjet recording method described in item 1 or item 2, characterized in that a layer thickness of said surface portion layer is from 3 to 10 μm.

4. The inkjet recording method described in any one of items 1 to 3, characterized in that the total layer thickness of said solvent absorbing layer is from 25 to 40 μm.

5. The inkjet recording method described in any one of items 1 to 4, characterized in that a weight ratio of said inorganic pigment to said resin fine particles (inorganic pigment/resin fine particles) is from 3/7 to 7/3.

6. The inkjet recording method described in any one of items 1 to 5, characterized in that a vacancy ratio (polocity) of said ink receiving layer is from 30 to 70%.

7. The inkjet recording method described in any one of items 1 to 6, characterized in that said support is comprised of paper and said resin layer and a melting point of said resin layer is from 100 to 180° C.

8. The inkjet recording method described in any one of items 1 to 7, characterized in that at least one kind of resin constituting said resin layer is polyolefin resin.

9. The inkjet recording method described in any one of items 1 to 8, characterized in that a glass transition temperature of said resin fine particles is from 50 to 180° C.

10. The inkjet recording method described in any one of items 1 to 9, characterized in that a mean particle diameter of said resin fine particles is from 50 to 500 μm.

11. The inkjet recording method described in any one of items 1 to 10, characterized in that a pressure of said heating and pressing means is not less than 0.6 MPa.

An inkjet recording apparatus utilized in the inkjet recording method described in any one of items 1 to 11, characterized in that an inkjet recording apparatus is equipped with a heat roller and a pressure roller to form a nip portion at the time of performing a heating and pressing treatment, and an image receiving medium is pressed by nipping pressure of between said heat roller and press roller.

13. An inkjet recording apparatus described in item 12 described above, characterized in being provided with an endless belt including said heat roller.

14. The inkjet recording apparatus described in item 12 described above, characterized in that the surface of said heat roller is covered by silicone resin.

15. The inkjet recording apparatus described in item 13 described above, characterized in that the surface of said endless belt is covered by silicone resin.

16. The inkjet recording apparatus described in item 12 or item 14, characterized in that said heat roller has a surface roughness of not more than 80 nm, and is brought in contact with the ink image receiving layer side of an image receiving medium.

17. The inkjet recording apparatus described in item 13 or item 15, characterized in that said endless belt has a surface roughness of not more than 80 nm and is brought in contact with the ink image receiving layer side of an image medium.

The inventors of the invention, as a result of extensive study in view of the above problems, have found that the object of the invention can be achieved by an inkjet recording method in which after ink containing pigment, water and an organic solvent is ejected on an image receiving medium, comprised of a support having a non-solvent-permeable resin layer provided with at least one solvent absorbing layer containing inorganic fine particles and a binder, and a surface portion layer containing resin fine particles, an inorganic pigment and a binder, being accumulated thereon, a heating and pressing treatment is performed, wherein said heating and pressing treatment satisfies conditions of above-described expressions (1) and (2) at the same time, and reached the invention.

As described above, an image forming method, in which graininess and image storage stability have been improved by including thermoplastic fine particles in a surface layer and by being subjected to heating and pressing after recording with pigment ink, is disclosed in JP-A No. 2002-178623, however, it has been proved that the improvement is not sufficient in the present stage of further improving printing speed.

Generally, it has been proved that increase in ink absorbing speed of an image receiving layer is necessary to increase printing speed, however, in the invention, a constitution having a rapid ink absorbing speed as an image receiving layer has been adopted. The inventors have found that an absorbing speed is improved more by a constitution incorporating an inorganic pigment than being comprised of only resin fine particles as a filler of a surface portion layer. However, it has been proved that to satisfy uniform and high gloss and abrasion resistance is difficult in case of performing a heating and pressing treatment after images are recorded on an image receiving layer comprised of said resin fine particles and an inorganic pigment.

On the other hand, to increase a pressure applied to rollers excessively, as a heating and pressing apparatus, makes the size of an apparatus itself large and is not preferable in respect to a cost.

For the above problems, the inventors have found that problems of the invention can be solved by defining conditions related to a melting point of a resin layer covering a support and a glass transition temperature of resin fine particles utilized in a surface portion layer to a specific region.

Further, as described above, in JP-A No. 2002-67295, an inkjet recording apparatus, which is provided with a head ejecting ink on an image receiving sheet comprised of an ink receiving layer containing thermoplastic fine particles on a surface layer and a solvent absorbing layer inside thereof, and a heating and pressing means, and having a heating and pressing time of from 0.1 to 2 seconds, a temperature of from 50 to 150° C. and a pressure of from $9.8\times10^4$ to $4.9\times10^6$ Pa, is disclosed. Even with the method, further improvement was required to achieve uniform gloss and abrasion resistance.

The reason of causing non-uniform gloss as a problem of the invention is not clear at the moment, however, it is estimated that it may be attributable to generation of such as foam at the time when a heating temperature reaches a temperature to cause fluidity of resin in a resin covering layer of a support.

The inventor have found, as a result of various studies with respect to treatment conditions to achieve uniform and high gloss, that it is necessary to set heating conditions within a specific range defined by a glass transition temperature of thermoplastic resin particles and a melting point of a resin layer of a support, to accomplish the invention.

DETAILED DESCRIPTION OF THE PREFERRED EMBODIMENT

Figure 1:
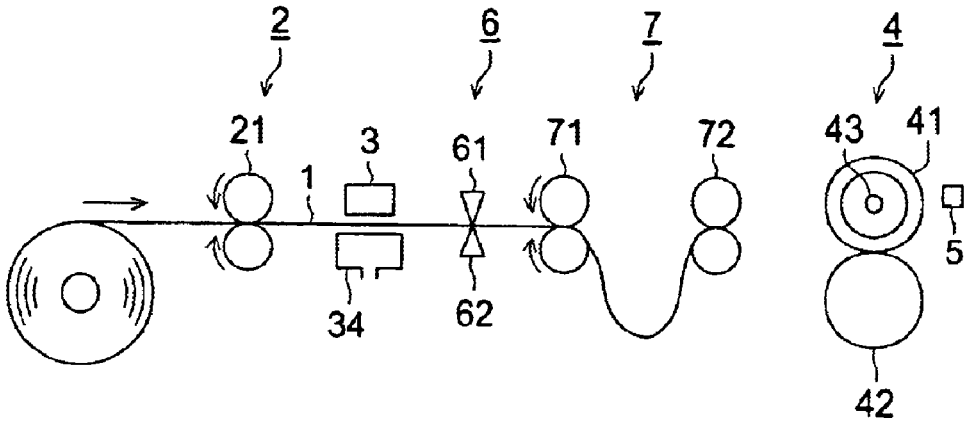
FIG. 1 is a brief constitutional drawing showing an example of an inkjet recording apparatus utilized in the invention.

In what follows, the invention will be detailed.

Firstly, an image receiving medium will be explained. In an image receiving medium according to the invention, at least one solvent absorbing layer containing inorganic fine particles and a binder, and a surface portion layer containing resin fine particles, an inorganic pigment and a binder, are accumulated on a support having a non-solvent-permeable resin layer to form an ink image receiving layer.

In the invention, a support covered with a non-solvent-permeable resin layer is utilized; in the invention, a support is preferably comprised of paper and a non-solvent-permeable resin layer, and a melting point of said resin layer is preferably from 100 to 180° C., and further, at least one kind of resin of a resin layer is preferably polyolefin resin.

In an image receiving medium according to the invention, a corona discharge treatment or an undercoating treatment is preferably performed prior to coating of a solvent absorbing layer for the purpose of such as to enhance adhesion strength between a support and a solvent absorbing layer. Further, an image receiving medium of the invention is not necessarily colorless, and may be colored recording paper.

In an image receiving medium according to the invention, as described above, a paper support in which the both sides of raw paper are laminated with polyolefin resin, concretely with polyethylene, is specifically preferably utilized, since there can be obtained recorded images having similar image quality to photographic images as well as high quality images at a low cost. Such a paper support laminated with polyethylene will be explained below.

Raw paper utilized for a paper support is made of wood pulp as a main raw material, if necessary, utilizing synthetic pulp such as polypropyrene or synthetic fiber such as nylon and polyester in addition to wood pulp. Any of LBKP, LBSP, NBKP, NBSP, LDP, NDP, LUKP and NUKP can be utilized as wood pulp, however, it is preferable to use more LBKP, NBSP, LBSP, NDP and LDP rich in a short fiber component. Herein, a ratio of LBSP and/or LDP is preferably not less than 10 weight % and not more than 70 weight %.

As the above-described pulp, chemical pulp (such as sulfate pulp and sulfite pulp) with minimal impurities is preferably utilized, and pulp of which whiteness has been improved by a bleach treatment is also useful. In raw paper, a sizing agent such as a higher fatty acid and an alkyl ketene dimer, a white pigment such as calcium carbonate, talk and titanium oxide, a paper strength enhancing agent such as starch, polyacrylamide and polyvinyl alcohol, a fluorescent whitening agent and a water retaining agent such as polyethylene glycol, a dispersant, and a softening agent such as quarterly ammonium can be suitably added.

A drainage of pulp utilized in paper making is preferably from 200 to 500 ml based on the definition of CSF, and, further, a fiber length after beating is preferably from 30 to 70% as the sum of a weight % of a 24 mesh residue and a weight % of a 42 mesh residue based on the definition of JIS-P-8207. Wherein, a weight % of a 4 mesh residue is preferably not more than 20 weight %. A basis weight of raw paper is preferably from 30 to 250 g/m$^2$ and specifically preferable from 50 to 200 g/m$^2$. A thickness of raw paper is preferably from 40 to 250 $\mu$m. Raw paper may be subjected to a calendar treatment at or after paper making to be provided with a high smoothness property. A density of raw paper is generally from 0.7 to 1.2 g/m$^2$ (JIS-P-8118). Further, a stiffness of raw paper is preferably from 20 to 200 g based on the conditions defined in JIS-P-8143. A surface sizing agent may be coated on the surface of raw paper, and a sizing agent, similar to those can be added in the above-described raw paper, can be utilized as a surface sizing agent. A pH of raw paper is preferably from 5 to 9 when it is measured according to a hot water extraction method defined in JIS-P-8113.

Polyethylene covering the front surface and the back surface of raw paper is mainly low density polyethylene (LDPE) and/or high density polyethylene (HDPE), and, in addition, such as LLDPE (linear low density polyethylene) and polypropyrene can be utilized partly; among them those having a melting point of from 100 to 180° C. are preferable. Specifically, as a polyethylene layer of the ink absorbing layer side, those of which opacity and whiteness having been improved by addition of titanium oxide of a rutile or anatase type in polyethylene are preferable. A content of titanium oxide is generally from 3 to 20 weight % and preferably from 4 to 13 weight %, based on polyethylene.

Polyethylene covered paper can be utilized as glossy paper and, in the invention, also as those on which a matte surface or a silk surface such as obtained in ordinary photographic paper is formed when polyethylene is coated by melting extrusion onto a raw paper surface.

A using amount of polyethylene on the front and back sides of raw paper is selected so as to optimize curl under low humidity and high humidity after a void layer and a back-coating layer are formed, and thickness of polyethylene is generally in a range of from 20 to 40 $\mu$m for the void layer side and in a range of from 10 to 30 $\mu$m for the back-coating layer side.

Further, a paper support covered with said polyethylene is preferably provided with the following characteristics.

1. Tensile strength: preferably from 20 to 300 N in the longitudinal direction and from 10 to 200 N in the width direction, based on strength defined by JIS-P-8113.

2. Tear strength: preferably from 0.1 to 20 N in the longitudinal direction and from 2 to 20 N in the width direction, based on a method defined by JIS-P-8116.

3. Compressive modulus of elasticity $\geqq$98.1 Mpa

4. Surface Beck's smoothness: preferably not less than 20 seconds under conditions defined by JIS-P-8119 as a glossy surface, however, it may be less than this value as for so called patterned products.

5. Surface roughness: A surface roughness defined by JIS-B-0601 is preferably not more than 10 $\mu$m as the maximum height per standard length of 2.5 mm.

6. Opacity: preferably not less than 80% and specifically preferably from 85 to 95% when it was measured by means of a method defined by JIS-P-8138.

7. Whiteness: preferably L*=from 80 to 95%, a*=from −3 to +5, and b*=from −6 to +2, based on L*, a* and b* defined by JIS-P-8729.

8. Surface glossiness: a 60 degree mirror surface glossiness defined by JIS-Z-8741 is preferably from 10 to 95%.

9. Clark stiffness: a support having a Clark stiffness in the transporting direction of from 50 to 300 $cm^2/100$ is preferable.

10. Water content of center stock: generally from 2 to 100 weight % and preferably 2 to 6 weight %, based on a center stock.

Next, a solvent absorbing layer (hereinafter, also referred to as an ink absorbing layer) according to the invention will be explained.

Main constituting elements of a solvent absorbing layer according to the invention are inorganic fine particles and a binder, which form a void-type ink absorbing layer.

As a void-type, a layer comprised of inorganic fine particles and a hydrophilic binder as a binder being coated and having gloss is specifically preferable.

In what follows, a void-type ink absorbing layer will be detailed.

A void-type is formed mainly by soft coagulation of a hydrophilic binder and inorganic fine particles. Various methods to form a void in a film layer are conventionally known, and for example, such as a method in which a homogeneous coating solution containing not less than two kinds of polymers is coated on a support and these polymers are made to be phase separated each other in a drying process to form a void; a method in which a coating solution containing solid fine particles and a hydrophilic or hydrophobic binder is coated on a support, and an inkjet recording paper, after having been dried, is immersed in a liquid containing water or a suitable organic solvent to dissolve solid fine particles resulting in a void production; a method in which a coating solution containing a compound having a property of foaming at the time of film formation, and the compound is made to foam during a drying process to form a void; a method in which a coating solution containing porous solid fine particles and a hydrophilic binder is coated on a support and a void is formed in porous fine particles and among fine particles; and a method in which a coating solution containing solid fine particles and/or fine particle oil droplets of approximately the same volume as that of a hydrophilic binder and a hydrophilic binder is coated on a support, and a void is formed among solid fine particles; are known. In the invention, a void layer is specifically preferably formed incorporating various inorganic fine particles having a mean particle diameter of not more than 100 nm.

Inorganic fine particles utilized for the above purpose can include, for example, white pigments such as light calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, silica, alumina, alumina hydrate, pseudo-boehmite, aluminum hydroxide, lithopone, zeolite and magnesium hydroxide.

A mean particle diameter of inorganic fine particles can be obtained by observing particles themselves or particles appearing on the cross section or surface of a void layer and measuring a particle diameter of arbitrary 1,000 particles through an electron-microscope to obtain the simple average value (number average). Herein, a particle diameter of each particle is represented by a diameter of a supposed circle having an equivalent area to the projected area.

As inorganic fine particles, solid fine particles selected from silica, and alumina or alumina hydrate are preferably utilized.

As silica which can be utilized in the invention, such as ordinary silica or colloidal silica synthesized by a wet method and silica synthesized by a gas phase method are preferably utilized, however, as fine particle silica specifically preferably utilized in the invention, colloidal silica or fine particle silica synthesized by a gas phase method is preferred and among them fine particle silica synthesized by a gas phase method is preferred since a higher void ratio is obtained as well as a coarse coagulate is hardly formed when being added to a cationic polymer used to fix a dye. Further, alumina or alumina hydrate may be crystal or amorphous, and arbitrary shaped particles such as irregular-shaped particles, circular-shaped particles and needle-shaped particles can be utilized.

In a fine particle dispersion solution before being mixed with a cationic polymer, inorganic fine particles are preferably in a state of being dispersed to primary particles.

The particle diameter of inorganic fine particles is preferably not more than 100 nm. For example, as for the above-described fine particle silica by a gas phase method, a mean particle diameter of primary particles of inorganic fine particles dispersed as a primary particle state is preferably not more than 100 nm, more preferably from 4 to 50 nm and most preferably from 4 to 20 nm.

As silica having a mean primary particle diameter of from 4 to 20 nm synthesized by a gas phase method, which is most preferably utilized, for example, Aerosil manufactured by Nippon Aerosil Co., Ltd. is available on the market. The fine particle silica by a gas phase method can be dispersed relatively easily to primary particles in water, for example, by being suction dispersed by use of Jet Streem Inductor Mixer produced by Mitamura Riken Kogyo Co., Ltd.

A hydrophilic binder (hereinafter, also referred to as a water-soluble resin) utilized in the invention includes, for example, such as polyvinyl alcohol, gelatin, polyethylene oxide, polyvinyl pyrrolidone, polyacrylic acid, polyacrylamide, polyurethane, dextrane, dextrin, carrageenan (such as κ, ι, λ), agar, pullulan, water-soluble polyvinyl butyral, hydroxyethyl cellulose and carboxymethyl cellulose. These hydrophilic binders can be utilized also in combinations of not less than two kinds.

A water-soluble resin preferably utilized in the invention is polyvinyl alcohol.

Polyvinyl alcohol preferably utilized in the invention includes modified polyvinyl alcohol such as polyvinyl alcohol of which an end-group is cation modified and anion modified polyvinyl alcohol having an anionic group other than ordinary polyvinyl alcohol obtained by hydrolysis of polyvinyl acetate.

As polyvinyl alcohol obtained by hydrolysis of polyvinyl acetate, those having a mean polymerization degree of not less than 1,000 are preferably utilized and of from 1,500 to 5,000 are specifically preferably utilized. Further, a saponification degree is preferably from 70 to 100% and specifically preferably from 80 to 99.5%.

Cation modified polyvinyl alcohol, for example, is polyvinyl alcohol having a primary to tertiary amino group or a quaternary ammonium group such as described in JP-A No. 61-10483 in the main chain or in the side chain, and can be obtained by saponifying a copolymer of an ethylenically unsaturated monomer having a cationic group and vinyl acetate.

An ethylenicaly unsaturated monomer having a cationic group includes, for example, such as trimethyl-(2-acrylamide-2,2-dimethylethyl)ammonium chloride, trimethyl-(3-acrylamide-3,3-dimethylpropyl)ammonium chloride, N-vinyl imidazole, N-vinyl-2-methylimidazole, N-(3-dimethylaminopropyl)methacrylamide, hydroxyethyl trimethylammonium chloride, trimethyl-(2-methacrylamidopropyl)ammonium chloride and N-(1,1-dimethyl-3-dimethylpropyl)acrylamide.

The ratio of a cation modified group containing monomer of cation modified polyvinyl alcohol is from 0.1 to 10 mol % and preferably from 0.2 to 5 mol %, based on vinyl acetate.

An anion modified polyvinyl alcohol includes, for example, polyvinyl alcohol having anion groups such as described in JP-A No. 1-206088, copolymers of vinyl alcohol and a vinyl compound having a water-soluble group such as described in JP-A Nos. 61-237681 and 63-307979, and modified polyvinyl alcohol having a water-soluble group such as described in JP-A No. 7-285265.

Further, nonion modified polyvinyl alcohol includes, for example, polyvinyl alcohol derivatives, in which a polyalkylene oxide group is added to a part of vinyl alcohol, such as described in JP-A No. 7-9758, and block copolymers of a vinyl compound having a hydrophobic group and vinyl alcohol described in JP-A No. 8-25795. Polyvinyl alcohol may be utilized also in combinations of not less than two kinds, such as of different polymerization degrees or kinds of modification.

An addition amount of inorganic fine particles utilized in an ink absorbing layer depends significantly on a required ink absorbing volume, a void ratio of a void layer, a kind of an inorganic pigment and a kind of a water-soluble resin, however, generally from 5 to 30 g and preferably from 10 to 25 g, per 1 $m^2$ of recording paper.

Further, a ratio of inorganic fine particles to a water-soluble resin utilized in an ink absorbing layer is generally from 2/1 to 20/1 and specifically preferably from 3/1 to 10/1, based on a weight ratio.

Further, a cationic water-soluble polymer having a quarterly ammonium group in a molecule may also be contained and it is utilized generally in a range of from 0.1 to 10 g and preferably from 0.2 to 5 g, per 1 $m^2$ of inkjet recording paper.

In a void layer, the total amount of a void (a void volume) is preferably not less than 20 ml per 1 $m^2$ of recording paper. Further, a void ratio is preferably from 30 to 70%.

Herein, the void ratio is obtained according to the following expression:

$$\text{Void ratio}=100\times(\text{water absorption value}/\text{total dry layer thickness})$$

Herein, a water absorption value can be measured, for example, according to a method described in JP-A No. 2002-19919.

In case of a void volume of less than 20 ml/$m^2$; ink absorption property is satisfactory when an ink amount is small, however, ink cannot be absorbed completely when an ink amount is large and problems such as to deteriorate image quality and to retard a drying property are liable to occur.

In a void layer having an ink retaining ability, it is preferable to form a void efficiently without making a layer thickness unnecessarily large by defining a void ratio to the above-described range.

Further, a solvent absorbing layer according to the invention may be constituted of not only one layer but also of not less than two layers, and a total layer thickness of the solvent absorbing layers is preferably from 25 to 40 $\mu$m.

As another type of a void-type, other than forming an ink absorbing layer by use of inorganic fine particles, an ink absorbing layer may be formed by utilizing a coating solution comprised of a polyurethane resin emulsion, being incorporated with a water-soluble epoxy compound and/or acetoacetylated polyvinyl alcohol and further being incorporated with epichlorohydrin polyamide resin. In this case, a polyurethane resin emulsion is preferably those provided with a polycarbonate chain, or with a polycarbonate chain and a polyester chain, and having a particle diameter of 3.0 $\mu$m, and it is further preferable that polyurethane resin of a polyurethane resin emulsion obtained by reacting polyol having polycarbonate polyol, or polycarbonate polyol and polyester polyol, with a fatty isocyanate compound has a sulfonate group in a molecule and further has epichlorohydrin polyamide resin and a water-soluble epoxy compound and/or acetoacetylated vinyl alcohol. In an ink absorbing layer utilizing the above-described polyurethane resin, it is estimated that a weak coagulate of an cation and an anion is formed to accompany formation of a void having an ink absorbing ability to enable image formation.

Next, a surface portion layer will be explained.

A surface portion layer according to the invention contains resin fine particles, an inorganic pigment and a binder, and a weight ratio of an inorganic pigment to resin fine particles (an inorganic pigment/resin fine particles) is preferably from 3/7 to 7/3 and further preferably from 4/6 to 6/4.

A surface portion layer referred to in the invention is not limited to an outermost surface layer of an image receiving medium and is not limited specifically provided that it is a constitution that exhibits the effects of the invention. An image receiving medium according to the invention exhibits most of the effects of the invention by melting resin fine particles included in a surface portion layer, for example, by means of heating and pressing after image recording. For example, the constitution belong to the present invention provided that there is, for example, improvement of gloss, improvement of abrasion resistance or improvement of a degree of bronzing, even when a layer containing an inorganic pigment and resin fine particles is not at the outermost surface side of an image receiving medium.

Preferable exemplary constitutions to manifest a surface portion layer referred to in the invention will be listed below, however a layer constitution according to the invention is not limited thereto.

1: A constitution in which a surface portion layer containing an inorganic pigment and resin fine particles is at the outermost surface side of an image receiving medium.

2: A constitution in which a thin layer to improve surface physical properties is provided on a surface portion layer containing an inorganic pigment and resin fine particles.

3: A constitution in which a thin layer having a ultraviolet ray absorbing function to cut a harmful light is provided on a surface portion layer containing an inorganic pigment and resin fine particles.

4: A constitution in which a matting agent containing layer is provided on a surface portion layer containing an inorganic pigment and resin fine particles.

5: A constitution in which a peelable layer is provided on a surface portion layer containing an inorganic pigment and resin fine particles.

The most preferable constitution among above-described constitutions is the case of item 1 in which a surface portion layer containing an inorganic pigment and resin fine particles is at the outermost surface side of an image receiving medium, which exhibit the effects of the invention most.

A solvent absorbing layer and a surface portion layer containing an inorganic pigment and resin fine particles in an ink receiving layer referred to in the invention are preferably dealt with as one layer in a manufacturing process of an image receiving medium and more preferably coated as a single layer by use of a single coating solution prepared in a manufacturing process.

A surface portion layer containing an inorganic pigment and resin fine particles according to the invention, comprised of such as an inorganic pigment, resin fine particles and a binder composition.

An inorganic pigment can be selected from inorganic pigments utilizable in the above-described void layer.

For example, white pigments such as light calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic amorphous silica, colloidal silica, alumina, colloidal alumina, pseudo-boehmite, aluminum hydroxide, lithopone, zeolite and magnesium hydroxide can be listed.

As a preferable inorganic pigment, solid fine particles selected from silica, alumina and alumina hydrate are utilized, and more preferably silica is utilized.

As silica, such as ordinary silica or colloidal silica synthesized by a wet method and silica synthesized by a gas phase method are preferably utilized, however, as fine particle silica specifically preferably utilized in the invention, colloidal silica or fine particle silica synthesized by a gas phase method is preferred and among them fine particle silica synthesized by a gas phase method is preferred since a higher void ratio is obtained as well as a coarse coagulate is hardly formed when being added to a cationic polymer used to fix a dye. Further, alumina or alumina hydrate may be crystal or amorphous, and arbitrary shaped particles such as irregular-shaped particles, circular-shaped particles and needle-shaped particles can be utilized. As an inorganic pigment, in the invention, silica and alumina are preferably utilized, and among them silica is more preferred.

In a fine particle dispersion solution before being mixed with a cationic polymer, inorganic fine particles are preferably in a state of being dispersed to primary particles.

The particle diameter of inorganic fine particles is preferably not more than 100 nm. For example, as for the above-described fine particle silica by a gas phase method, a mean particle diameter of primary particles of inorganic fine particles dispersed as a primary particle state is preferably not more than 100 nm, more preferably from 4 to 50 nm and most preferably from 4 to 20 nm.

Resin fine particles utilizable in the invention can include, for example, polycarbonate, polyacrylonitrile, polystyrene, polyacrylic acid, polymethacrylic acid, polyvinyl chloride, polyvinylidene chloride, polyvinyl acetate, polyester, polyamide, polyether, copolymers thereof and salts thereof. Among them styrene-acrylic acid ester copolymer, vinyl chloride-vinyl acetate copolymer, vinyl chloride-acrylic acid ester copolymer, ethylene-vinyl acetate latex are preferable. Further, resin fine particles may be utilized in combinations of plural polymers having different monomer compositions, particle diameters or polymerization degrees.

At the time of selecting resin fine particles, ink affinity, gloss of an image after being fixed by heating and pressing, image fastness and a releasing property should be taken into consideration.

As for ink affinity, ink absorbing speed is improved by faster separation of pigment particles and an ink solvent in pigment ink, when a particle diameter of resin fine particles is not less than 50 nm. Further, when it is not more than 500 $\mu$m, it is preferable in respect to film strength and gloss of an inkjet image receiving medium after being coated and dried. Therefore, a particle diameter of resin fine particles is preferably from 50 to 500 nm and more preferably from 100 to 300 nm.

A standard for selection of resin fine particles includes glass transition temperature (Tg). In case of a Tg is higher than coating and drying temperatures, a void formed by resin fine particles can be retained, for example, due to coating and drying temperatures at the time of manufacturing of an image receiving medium are already lower than a Tg. Further, a Tg is lower than a temperature at which a support causes deformation by heating, a fixing operation at lower temperatures is possible to perform melting and film formation after inkjet recording with pigment ink resulting no problems of such as a load with respect to an apparatus and thermal stability of a support. A Tg of resin fine particles is preferably from 50 to 180° C. and more preferably from 60 to 150° C.

Further, a minimum film forming temperature (MFT) is preferably from 50 to 150° C.

Resin fine particles are preferably those dispersed in a water based phase in respect to environmental adaptability and specifically preferably a water based latex prepared by emulsion polymerization. In this case, a type prepared by emulsion polymerization by use of a nonion dispersant as an emulsifying agent is an embodiment preferably utilized. Further, resin fine particles preferably contains a residual monomer component as little as possible, in respect to odor and safety, and it is preferably not more than 3 weight %, more preferably not more than 1 weight % and furthermore preferably not more than 0.1 weight %, based on a solid component of a polymer.

A solid component amount of a surface portion layer containing an inorganic pigment and resin fine particles is not specifically limited, however is preferably in a range of from 2 to 50 g/m$^2$ and more preferably in a range of from 3 to 30 g/m$^2$.

In an image receiving medium according to the invention, a solid amount of resin fine particles contained in a surface portion layer is preferably in a range of from 0.5 to 15 g/m$^2$ and specifically preferably in a range of from 1 to 7 g/m$^2$. When a solid amount is in the above range, a satisfactory film can be formed and pigment can be dispersed sufficiently in a film. Therefore, image quality and gloss are high. Further, resin fine particles can be converted into a film completely by a heating process in a short time and fine particles can fuse together to exhibit high transparency and improved image quality. Further, an ink absorbing speed is fast and no boundary bleeding is generated. Further, a void ratio of a surface portion layer is preferably 30 to 70%.

In a surface portion layer coating solution containing an inorganic pigment and resin fine particles, an inorganic pigment and resin fine particles may be dispersed simultaneously or may be mixed at the time of preparation of a coating solution after each of them has been prepared by dispersion.

Next, a manufacturing method of an image receiving medium according to the invention will be explained.

As a manufacturing method of an image receiving medium, each layer composition including plural number of solvent absorbing layers can be coated each separately or simultaneously on a support and dried by means of a suitably selected method from well known coating methods to manufacture the medium. As a coating method, for example, such as a roll coating method, a rod bar coating method, an air-knife coating method, a spray coating method, a curtain coating method, or a slide bead method utilizing hoppers described in U.S. Pat. Nos. 2,761,419 and 2,761,791, and an extrusion coating method are preferably utilized.

In the invention, as for a manufacturing method of an image receiving medium having an ink image receiving layer, it is preferably manufactured by simultaneous multi-layer coating of a surface portion layer containing an inorganic pigment and resin fine particles and a solvent absorbing layer adjacent thereto. Most preferable coating style is simultaneous multi-layer coating of all layers constituting an ink receiving layer.

A viscosity of each coating solution at the time of simultaneous multi-layer coating is preferably in a range of from 5 to 100 mPa·s and more preferably in a range of from 10 to 50 mPa·s, when a slide bead coating method is applied. Further, it is preferably in a range of from 5 to 1200 mPa·s and more preferably in a range of from 25 to 500 mPa·s, when a curtain coating method is applied.

Further, a viscosity of a coating solution at 15° C. is preferably not less than 100 mPa·s, more preferably from 100 to 30,000 mPa·s and most preferably from 10,000 to 30,000 mPa·s.

As a coating and drying method, it is preferable that a coating solution is heated at not lower than 30° C., after having been coated by simultaneous multi-layer coating, a temperature of a formed film is once cooled down to from 1 to 15° C. and then the film is dried at not lower than 10° C. Preparation, coating and drying are preferably performed at a temperature of not higher than the Tg of said resin fine particles, so that resin particles included in a surface portion layer may not form a film at the time of preparation, coating and drying of a coating solution. It is more preferable to manufacture under drying conditions of a wet bulb of from 5 to 50° C. and a film surface temperature of from 10 to 50° C. Further, cooling immediately after coating is preferably performed by a horizontal set method in view of uniformity of a coated film.

Next, ink will be explained.

In an inkjet recording method of the invention, an image is recorded firstly on an image receiving medium by use of an inkjet printer. In the invention, one of characteristics of an inkjet image forming method is that resin fine particles included in a surface portion layer is melt and made into a film by a heating and pressing treatment after inkjet image recording, and effects are exhibited in respect to image quality and image storage stability.

As ink utilized in image recording, such as a water-based ink composition, an oil-based ink composition and a solid (phase transformation) ink composition can be utilized, and a water-based ink composition (for example, such as a water-based inkjet recording solution containing not less than 10 weight % of water based on a total ink weight) is specifically preferably utilized.

In the invention, a pigment is utilized as a colorant. This is preferable particularly in respect to image storage stability. As a pigment utilized in pigment ink, organic pigments such as an insoluble pigment and a lake pigment, and carbon black can be preferably utilized.

An insoluble pigment is not specifically limited, however, for example, such as azo, azomethine, methine, diphenyl methane, triphenyl methane, quinacridone, anthraquinone, perylene, indigo, quinophthalone, isoindolinone, isoindoline, azine, oxazine, thiazine, dioxazine, thiazole, phthalocyanine and diketo pyrrolopyrrol are preferable.

Preferably utilizable pigments concretely include the following:

As pigments for magenta or red, for example, such as C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222 are listed.

As pigments for yellow, for example, such as C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94 and C. I. Pigment Yellow 138 are listed.

As pigments for green or cyan, for example, such as C.I. Pigment Blue 15, C.I. Pigment Blue 15:2, C.I. Pigment Blue 15:3, C.I. Pigment Blue 16, C. I. Pigment Blue 60 and C. I. Pigment Green 7 are listed.

For these pigments, a dispersant may be utilized when necessary, and utilizable pigment dispersants include, for example, surfactants such as a higher fatty acid salt, alkyl sulfate, alkyl ester sulfate, alkyl sulfonate, sulfosuccinate, naphthalene sulfonate, alkyl phosphate, polyoxyalkylene alkylether phosphate, polyoxyalkylene alkylphenylether, polyoxyethylene polyoxypropylene glycol, glycerin ester, sorbitan ester, polyoxyethylene fatty acid amide and amine oxide; or block copolymers, random copolymers and salts thereof comprised of not less than two monomers selected from styrene, styrene derivatives, vinylnaphthalene derivatives, acrylic acid, acrylic acid derivatives, maleic acid, maleic acid derivatives, itaconic acid, itaconic acid derivatives, fumaric acid and fumaric acid derivatives.

As a dispersion method of a pigment, for example, various kinds of dispersion apparatuses such as a ball mill, a sand mill, an atliter, a roll mill, an agitator, a Henschel mixer, a colloidal mixer, an ultrasonic homogenizer, a pearl mill, a wet-type jet mill, and a paint shaker can be utilized. Further, a centrifugal separator or a filter is also preferably utilized, for the purpose of eliminating coarse particles of a pigment dispersion.

A mean particle diameter of pigment particles in pigment ink is selected in consideration of such as stability in ink, image density, glossy appearance and light fastness, in addition, in an image forming method of the invention, particle diameter is suitably selected also in respect to gloss improvement and sensation in quality improvement. The reason of improvement of gloss or sensation in quality in the invention is not clear at present, however, it is estimated that it is related to a pigment being dispersed in a preferable state in a film comprised of melted resin fine particles, in a formed image. In case of aiming a high speed treatment, it is necessary to melt resin fine particles to be made into a film as well as to sufficiently disperse a pigment in a film within a short time. At this time, a surface area of a pigment may significantly influence this process, so that the most suitable region of a mean particle diameter is considered to exist.

A water-based ink composition as a preferable form of pigment ink preferably incorporate a water-soluble organic solvent. A water-soluble organic solvent utilizable in the invention includes, for example, such as alcohol series (for example, such as methanol, ethanol, propanol, isopropanol, butanol, isobutanol, secondary butanol, tertiary butanol, pentanil, hexanol, cyclohexanol and benzyl alcohol), polyhydric alcohol series (for example, such as ethylene glycol, diethylene glycol, triethylene glycol, polyethylene glycol, propylene glycol, dipropylene glycol, polypropyrene glycol, butylene glycol, hexane diol, pentane diol, glycerine, hexane triol and thiodiglycol), polyhydric alcohol ether series (for example, such as ethyleneglycol monomethylether, ethyleneglycol monoethylether, ethyleneglycol monobutylether, diethyleneglycol monomethylether, diethyleneglycol monoethylether, diethyleneglycol monobutylether, propyleneglycol monomethylether, propyleneglycol monobutylether, ethyleneglycol monomethylether actate, triethyleneglycol monomethylether, triethyleneglycol monoethylether, triethyleneglycol monobutylether, ethyleneglycol monophenylether and propyleneglycol monophenylether), amine series (for example, such as ethanol amine, diethanol amine, triethanol amine, N-methyl diethanol amine, N-ethyl diethanol amine, morphorine, N-ethyl morphorine, ethylene diamine, diethylene diamine, triethylene tetramine, tetraethylene pentamine, polyethylene imine, pentamethyl diethylene triamine and tetramethyl propylene diamine), amide series (for example, such as formamide, N,N-dimethyl formamide and N,N-dimethyl acetoamide), heterocyclic series (for example, such as 2-pyrrolidone, N-methyl-2-pyrrolidone, cyclohexyl pyrrolidone, 2-oxazolidone and 1,3-dimethyl-2-imidazolidinone), sulfoxide series (for example, such as dimethyl sulfoxide), sulfon series (for example, such as sulforane), urea, acetonitrile and acetone. A preferable water-soluble organic solvent includes polyhydric alcohol series. Further, a combination of polyhydric alcohol and polyhydric alcohol ether is specifically preferably utilized.

A water-soluble organic solvent may be utilized alone or in combinations of plural kinds. An addition amount of a water-soluble organic solvent in ink is from 5 to 60 weight % and preferably from 10 to 35 weight %, as a total amount.

In an ink composition, when necessary, according to the purpose of improving various capabilities such as ejection stability, adaptability to a print head or to an ink cartridge, storage stability, image storage stability and the like, various kinds of additives well known in the art, for example, such as a viscosity control agent, a surface tension control agent, a specific resistance control agent, a film forming agent, a dispersant, a surfactant, an UV absorbent, an anti-oxidant, an anti-fading agent, an anti-mold agent and an anti-stain agent can be utilized by suitable selection. For example, organic latex fine particles of such as polystyrene, a polyacrylic acid ester series, a polymethacrylic acid ester series, a polyacrylamide series, polyethyrene, polypropyrene, polyvinyl chloride, polyvinylidene chloride, or copolymers thereof, urea resin, or melamine resin; oil fine particles of such as liquid paraffin, dioctylphthalate, tricresylphosphate and silicone oil; various surfactants of cation or nonion; UV absorbents described in JP-A Nos. 57-74139, 57-87988 and 62-261476; anti-fading agents described in such as JP-A Nos. 57-74192, 57-87989, 60-72785, 61-146591, 1-95091 and 3-13376; fluorescent whitening agents described in such as JP-A Nos. 59-42993, 59-52689, 62-280069, 61-242871 and 4-219266; pH control agents such as sulfuric acid, phosphoric acid, citric acid, sodium hydroxide and potassium carbonate are listed.

An ink composition preferably has a viscosity at flying of not more than 40 mPa·s and more preferably not more than 30 mPa·s. Further, an ink composition preferably has a surface tension at flying of not less than 20 mN/m and more preferably from 30 to 45 mN/m.

An inkjet recording method of the invention will be explained.

An inkjet recording method of the invention is characterized in utilizing a heating and pressing apparatus which treats a printed image by heat and pressure, and in the invention, for example, in case of forming inkjet pigment images, an apparatus is not specifically limited as far as provided with an image receiving medium storing section, a transport section, an ink cartridge and an inkjet print head as printers available on the market, however, a series of printer sets having at least a storing section for an image receiving medium of a roll-shape, a transport section, an inkjet print head, a cutting section, a heating section, a pressing section and a recorded print storing section is useful in case of utilizing inkjet photos in commercial applications.

In what follows, a heating and pressing apparatus utilized in the invention will be explained.

In the invention, to obtain an image having excellent glossiness after fixing, a heating and pressing apparatus utilized in the invention preferably applied a heating and pressing means mainly comprised of an endless belt or a fixing roller.

In the invention, heating and pressing conditions are satisfactory when they provide an image receiving medium particularly an image with as much energy as the effects of the invention are exhibited sufficiently, and it is a characteristic that a heating and pressing treatment is performed under conditions satisfying the relation defined by the following expressions (1) and (2) at the same time.

$$(T-T_G)\times t>2 \quad \text{Expression (1)}$$

$$(T-T_M)\times t<3 \quad \text{Expression (2)}$$

In the above each expression, T represents a surface temperature (° C.) of a heating member which is arranged at the ink image receiving layer side, $T_G$ represents a glass transition temperature of resin fine particles (° C.), t represents heating and pressing time (second), and $T_M$ represents a melting temperature (° C.) of a resin layer.

Further, $(T-T_G)\times t$ is preferably a value more than 4 and more preferably more than 6.

Specifically, in case of a pigment image, as a temperature to make an image smooth, T is preferably in a range of from 60 to 200° C. and more preferably from 80 to 160° C.

A heating and pressing time (a nip time), t, being referred to in the invention can be calculated according to the following expression.

$$\text{Nip time } t \text{ (sec)} = \text{nip width (mm)}/\text{transport speed (mm/sec)}$$

The above-described nip width can be obtained according to the following method.

1. Presscale for Ultra-low Pressure (manufactured by Fuji Photo Film Corp.) is cut in a short stripe having a width of 3 cm, and is sandwiched uniformly fitting to a length of a roller. In the occasion, a thickness of Presscale is 90 $\mu$m, which is added with that of a polyethylene terephthalate film, and a nip space is adjusted to the thickness of an image receiving medium. In the occasion, heating of a roller is not performed.

2. Press is kept for 1 minute under an environment of 25° C. and 50% RH.

3. Press is released and a red changed width on Presscale is measured to be a nip width.

A heating and pressing treatment may be performed by a heating and pressing device equipped with in a printer, or may be performed by a separate heating and pressing device. As a heating and pressing means, a heat roller is preferably utilized in both cases of a fixing roller and of an endless belt because of no unevenness generation, space saving in addition to enabling a continuous process.

A heat roller is provided with a hollow roller as a constituent component and rotates by a driving means, and an exothermic member comprised of, for example, such as a halogen lamp heater, a ceramic heater and a nicrome wire is preferably included as a heat source in a hollow part.

Further, a roller is preferably made of a material having a high thermal conductivity, specifically preferably of a metal and more preferably of nickel among them.

A transport speed of an image receiving medium in case of utilizing an endless belt or a fixing roller is preferably in a range of from 1 to 100 mm/sec and furthermore preferably in a range of from 5 to 50 mm/sec. This is preferable in respect to image quality as well as to high speed processing.

In the invention, the surface which contacts with an image receiving layer side in case of utilizing an endless belt, and the surface of a heat roller which contacts with an image receiving layer side in case of utilizing a heat roller, are preferably covered with silicone resin. Silicone resin can includes such as methyl silicone, dimethyl silicone and phenyl silicone, and those available on the market include such as KR271 and KR255, manufactured by Shin-Etsu Chemicals Co., Ltd.; SR2400, SR2406, SR2410 and SR 2411, manufactured by Toray-Dow Corning Silicon Co., Ltd.; and TSR116, manufactured by Toshiba Silicone Corp.; and modified silicone resin includes such as KR206 (alkyd modified), KR9706 (acryl modified), ES1001N (epoxy modified), KR5203 (polyester modified), manufactured by Shin-Etsu Chemicals Co., Ltd.; SR2115 (epoxy modified) and SR2107 (alkyd modified), manufactured by Toray Silicone Co., Ltd.; and TSR175 (alkyd modified) and TSR171 (urethane modified), manufactured by Toshiba Silicone Corp.

Further, in the invention, a surface roughness of a surface of a heat roller or an endless belt, which contacts with an ink image receiving side of an image receiving medium, is preferably not more than 80 nm and more preferably from 1 to 20 nm. Surface roughness referred to in the invention is center-line mean roughness (Ra) when measured at a measurement length of 2.5 mm and a cut off value of 0.8 mm defined by JIS-B-0601, and can be measured, for example, by use of such as RSTPLUS non-contact three dimensional fine surface shape measurement system, produced by WYKO Co., Ltd.

In the invention, a heating and pressing treatment is performed by pressing simultaneously with heating to obtain higher sensation in quality and gloss, and pressing may be performed after or continuous to the treatment. For example, in case of utilizing an endless belt, a heating and pressing treatment is performed basically at the portion where the belt contacts with a heat roller. A pressure for pressing is preferably not less than 0.6 Mpa and more preferably from 0.6 to 2.0 Mpa, to accelerate film forming.

A heating and pressing treatment apparatus utilized in the invention will be explained in reference to FIGS. 1 and 2.

FIG. 1 is a brief constitutional drawing showing an example of an inkjet recording apparatus utilized in the invention. In FIG. 1, image receiving medium 1 which is sent out by transport roller pair 21 from an image receiving medium roll wound in a roll-shape, being subjected to inkjet recording with recording head 3 and suitably cut by cutter 61, is transported from first roller pair 71 to second roller pair 72 in a state of having a slack, and, consecutively, sent to heating and pressing means 4 to be subjected to a heating and pressing treatment by passing between heat roller 41, provided with exothermic member 43 inside, and press roller 42.

Figure 2:
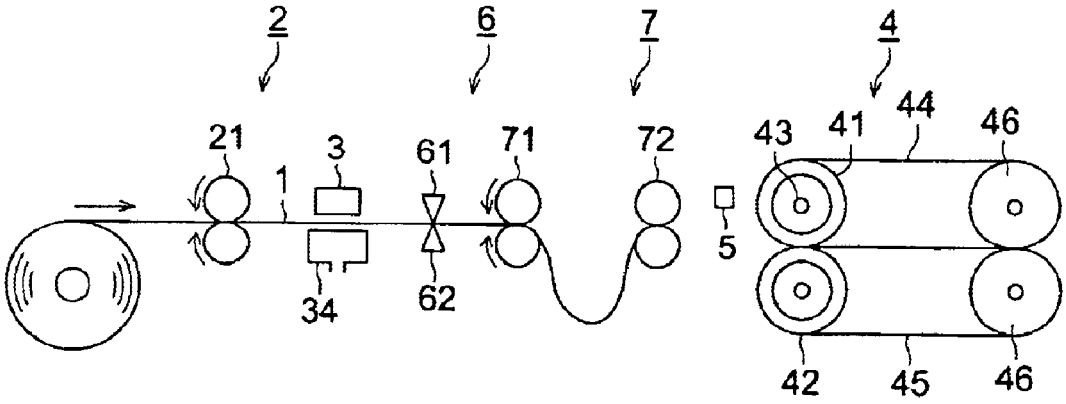
FIG. 2 is a brief constitutional drawing showing another example of an inkjet recording apparatus utilized in the invention.

FIG. 2 is a brief constitutional drawing showing another example of an inkjet recording apparatus utilized in the invention. In FIG. 2, image receiving medium 1 which is sent out by transport roller pair 21, being subjected to inkjet recording with recording head 3 and suitably cut by cutter 61, is transported from first roller pair 71 to second roller pair 72 in a state of having a slack, and, consecutively, sent to heating and pressing means 4 to be subjected to a heating and pressing treatment by passing, via endless-belts 44 and 45, between heat roller 41, provided with exothermic member 43 inside, and press roller 42.

On the surface of the above-described endless belt contacting with said image receiving medium 1, a releasing layer is provided, although it is not shown in the figure, and silicone resin according to the invention is included in said releasing layer. In an example shown in FIG. 2, endless belts including each of heat roller 41 and press roller 42 were utilized, however, a heating and pressing treatment can be also performed, for example, by endless belt 44 including heat roller 41 with press roller 42.

Excellent gloss and gloss uniformity can be achieved by performing a heating and pressing treatment such as described above, after inkjet recording on an image receiving medium comprised of a constitution according to the invention.

EXAMPLES

In what follows, the invention will be explained concretely according to examples, however, the invention is not limited thereto.

<Preparation of Inkjet Recording Medium>

An inkjet recording medium was prepared according to the following procedure.

<Preparation of Each Dispersion Solution>

<Preparation of Titanium Oxide Dispersion Solution-1>

Titanium oxide of 20 kg having a mean particle diameter of 0.25 μm (manufactured by Ishihara Sangyo Kaisha, Ltd.: W-10) were added into an aqueous solution of 90 liters containing 150 g of sodium tripolyphosphate having a pH of 7.5, 500 g of polyvinyl alcohol (manufactured by Kraray Co., Ltd.: PVA235, a mean polymerization degree of 3500), 150 g of cationic polymer (P-1) and 10 g of defoaming agent SN381, manufactured by Sunnopco Co., Ltd., and the system was made up to 100 liters after having been dispersed by use of a high pressure homogenizer (produced by Sanwa Kogyo Co., Ltd.) to obtain homogeneous titanium oxide dispersion solution-1.

<Chemical Structure 1>

P-1

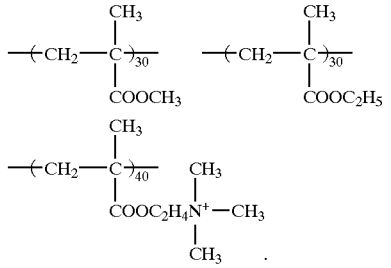

Mn = 13 kilo

<Preparation of Silica Dispersion Solution-1>

After silica by a gas phase method (manufactured by Nippon Aerosil Kogyo Co., Ltd: A300) of 125 kg having a primary particle diameter of 0.007 μm were suction dispersed at room temperature in pure water of 620 liters of which pH having been adjusted to 2.5 by nitric acid, by use of Jet Stream Inductor Mixer TDS, produced by Mitamura Riken Kogyo Co., Ltd., the total volume was made up to 694 liters with pure water. The dispersion solution was diluted to be photographed by an electron-microscope, and it was confirmed that from 85 to 90% by number of particles based on the total particles had a mean particle diameter of not more than 0.01 μm to have been dispersed to a primary particles.

<Preparation of Silica Dispersion Solution-2>

Above-described silica dispersion solution-1 of 69.4 liters were added with stirring in 20 minutes at a temperature range of from 25 to 30° C. to a solution (pH=2.3) of 18 liters containing 1.41 kg of cationic polymer (P-2) and 4.2 liters of ethanol, subsequently, an aqueous solution of 7.0 liters (pH=7.3) containing 260 g of boric acid and 230 g of borax were added in approximately 10 minutes followed by addition of 1 g of above described defoaming agent SN 381. The mixed solution was dispersed twice with a high pressure homogenizer, produced by Sanwa Kogyo Co., Ltd., at a pressure of 24.5 Mpa, and the total volume was made up to 97 liters to prepare nearly transparent silica dispersion solution-2.

<Chemical Structure 2>

P-2

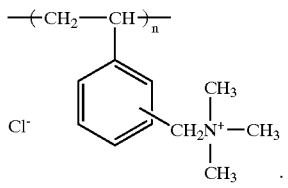

Mn = 24 kilo

<Preparation of Silica Dispersion Solution-3>

After silica by a gas phase method (manufactured by Tokuyama Corp.: QS-20) of 125 kg having a primary particle diameter of 0.012 μm were suction dispersed in 620 L of pure water of which pH having been adjusted to 2.5 with nitric acid by use of Jet Stream Inductor Mixer TDS, produced by Mitamura Riken Kogyo Co., Ltd., the total volume was made up to 694 L to prepare silica dispersion solution-3.

<Preparation of Silica Dispersion Solution-4>

Above-described silica dispersion solution-3 of 69.4 L were added with stirring into an aqueous solution (pH=2.3) of 18 L containing 1.14 kg of cationic polymer (P-1) and 2.2 L of ethanol and 1.5 L of n-propanol, subsequently, an aqueous solution of 7.0 liters containing 260 g of boric acid and 230 g of borax were added followed by addition of 1 g of defoaming agent SN 381 (manufactured by Sunnopco Co., Ltd.). The mixed solution was dispersed with a high pressure homogenizer, produced by Sanwa Kogyo Co., Ltd., and the total amount was made up to 97 L to prepare silica dispersion solution-4.

<Preparation of Fluorescent Whitening Agent Dispersion Solution-1>

Oil-soluble fluorescent whitening agent UVITEX-OB, manufactured by Ciba-Geigy Co., of 400 g were dissolved with heating in 9.0 kg of diisodecyl phthalate and 12 L of ethyl acetate, and the resulting solution was added to 65 L of an aqueous solution containing 3.5 kg of acid-processed gelatin and 6000 ml of 50% aqueous solution of cationic polymer (P-2) to be mixed and was emulsifying dispersed three times with a high pressure homogenized, produced by Sanwa Kogyo Co., Ltd., at a pressure of 24.5 Mpa; then the total volume was made up to 100 L after ethyl acetate was eliminated under reduced pressures to prepare fluorescent whitening agent dispersion solution-1. A pH of the dispersion solution was approximately 5.3.

<Preparation of Thermoplastic Fine Particle Coating Solution>

<Preparation of Thermoplastic Fine Particle Coating Solution-1>

Methylmethacrylate-acrylic acid ester copolymer (a Tg of 74° C., a mean particle diameter of 250 nm), having been emulsion polymerized by use of polyvinyl alcohol as a emulsifying agent, was adjusted to a pH of 4.7 with 6% nitric acid aqueous solution to be thermoplastic fine particle coating solution-1.

<Preparation of Thermoplastic Fine Particle Coating Solution-2>

Chemiparl W-300 (manufactured by Mitsui Chemical Co., Ltd., low molecular weight polyolefin, a Tg of 132° C., a mean particle diameter of 3 μm) was adjusted to a pH of 4.7 with 6% nitric acid aqueous solution to be thermoplastic fine particle coating solution-2.

<Preparation of Thermoplastic Fine Particle Coating Solution-3>

Styrene-acrylic acid ester copolymer (a Tg of 45° C., a mean particle diameter of 181 nm), having been emulsion polymerized by use of polyvinyl alcohol as a emulsifying agent, was adjusted to a pH of 4.7 with 6% nitric acid aqueous solution to be thermoplastic fine particle coating solution-3.

<Preparation of Each Coating Solution>

After each coating solution was prepared as described below, each coating solution was filtered by use of a filter available on the market (TCP 10 or TCP 30, manufactured by Toyo Roshi Co., Ltd.).

<Preparation of Coating Solution 1>

Coating solution 1 was prepared by mixing the following additives successively into 650 ml of above-described silica dispersion solution-2 with stirring at 40° C.

| | |
|---|---|
| 7% aqueous solution of polyvinyl alcohol (manufactured by Kraray Co., Ltd.: PVA 235, a mean polymerization degree of 3500) | 201.6 ml |
| Fluorescent whitening dispersion solution-1 | 35 ml |
| The total volume was made up to 1000 ml. A pH of the coating solution was 4.4. | |

<Preparation of Coating Solution 2>

Coating solution 2 was prepared by mixing the following additives successively into 600 ml of above-described silica dispersion solution-4 with stirring at 40° C.

| | |
|---|---|
| 10% aqueous solution of polyvinyl alcohol (manufactured by Kraray Co., Ltd.: PVA 203) | 6 ml |
| 7% aqueous solution of polyvinyl alcohol (manufactured by Kraray Co., Ltd.: PVA 235) | 185 ml |
| The total volume was made up to 1000 ml. | |

<Preparation of Coating Solution 3>

After mixing by use of thermoplastic fine particle coating solution 1 above-prepared and above-described coating solution 1, so as to make a solid weight ratio of thermoplastic fine particles to an inorganic pigment of 50/50, water was added to make a viscosity at 43° C. to be 45 mPa·s to prepare coating solution 3.

<Preparation of Coating Solution 4>

After mixing by use of thermoplastic fine particle coating solution 2 above-prepared and above-described coating solution 1, so as to make a solid weight ratio of thermoplastic fine particles to an inorganic pigment of 50/50, water was added to make a viscosity at 43° C. to be 45 mPa·s to prepare coating solution 4.

<Preparation of Coating Solution 5>

After mixing by use of thermoplastic fine particle coating solution 3 above-prepared and above-described coating solution 1, so as to make a solid weight ratio of thermoplastic fine particles to an inorganic pigment of 50/50, water was added to make a viscosity at 43° C. to be 45 mPa·s to prepare coating solution 5.

<Preparation of Inkjet Recording Medium>

<Preparation of Sample 1>

On paper support 1 (having a thickness of 220 μm, containing 13 weight % of anatase-type titanium oxide, based on polyethylene, in polyethylene of an ink absorbing layer surface) of which the both surfaces having been covered with polyethylene (glass transition temperature $T_M$: 114° C.), each coating solution of the first layer, the second layer, the third layer and the forth layer in this order from the support side was coated by simultaneous four layer coating with a slide hopper, according to the following constitution, and dried. Herein, each coating solution was coated by being heated at 40° C.; being cooled for 20 seconds in a cooling zone kept at 0° C. immediately after coating; being dried with air of 25° C. (a relative humidity of 15%) for 60 seconds, with air of 45° C. (a relative humidity of 25%) for 60 seconds and with air of 50° C. (a relative humidity of 25%) for 60 seconds successively; and after being rehumidified under an atmosphere of from 20 to 25° C. and a relative humidity of from 40 to 60% for 2 minutes, the sample was wound up to prepare sample 1.

| | |
|---|---|
| The first layer: | coating solution 2<br>a wet thickness of 50 μm |
| The second layer: | coating solution 2<br>a wet thickness of 50 μm |
| The third layer: | coating solution 2<br>a wet thickness of 50 μm |
| The forth layer: | coating solution 2<br>a wet thickness of 50 μm |

<Preparation of Sample 2>

Sample 2 was prepared in a similar manner to preparation of above sample 1, except that paper support 2 of which the both surfaces having been covered with polypropyrene (glass transition temperature $T_M$: 160° C.) instead of paper support 1.

<Preparation of Sample 3>

Sample 3 was prepared in a similar manner to preparation of above sample 2, except that coating solution 4 was utilized as the fourth layer coating solution.

<Preparation of Sample 4>

Sample 4 was prepared in a similar manner to preparation of above sample 1, except that coating solution 5 was utilized as the fourth layer coating solution.

<Preparation of Sample 5>

Sample 5 was prepared in a similar manner to preparation of above sample 1, except that coating solution 4 was utilized as the fourth layer coating solution.

<Preparation of Ink>

A water-based pigment ink was prepared according to the procedure described below.

<Preparation of Pigment Dispersion Solution>

<Preparation of Yellow Dispersion 1>

| | |
|---|---|
| C. I. Pigment Yellow 74 | 20 weight % |
| Styrene-acrylic acid copolymer (a molecular weight of 10,000, an acid value of 120) | 12 weight % |
| Diethylene glycol | 15 weight % |
| Ion-exchanged water | 53 weight % |

After the above each composition was mixed, the system was dispersed by use of a horizontal-type beads mill (System Zeta Mini, produced by Ashizawa Co., Ltd.) filled with zirconia beads of 0.3 mm diameter at a volume ratio of 60%, to prepare yellow dispersion 1. A mean particle diameter of yellow pigment obtained was 12 nm.

<Preparation of Magenta Dispersion 1>

| | |
|---|---|
| C. I. Pigment Red 122 | 25 weight % |
| Johncryl 61 (acryl-styrene type resin, manufactured by Jhonson Co.) (solid content) | 18 weight % |
| Diethylene glycol | 15 weight % |
| Ion-exchanged water | 42 weight % |

After the above each composition was mixed, the system was dispersed by use of a horizontal-type beads mill (System Zeta Mini, produced by Ashizawa Co., Ltd.) filled with zirconia beads of 0.3 mm diameter at a volume ratio of 60%, to prepare magenta dispersion 1. A mean particle diameter of magenta pigment obtained was 105 nm.

<Preparation of Cyan Dispersion 1>

| | |
|---|---|
| C. I. Pigment Blue 15:3 | 25 weight % |
| Johncryl 61 (acryl-styrene type resin, manufactured by Jhonson Co.) (solid content) | 15 weight % |
| Glycerin | 10 weight % |
| Ion-exchanged water | 50 weight % |

After the above each composition was mixed, the system was dispersed by use of a horizontal-type beads mill (System Zeta Mini, produced by Ashizawa Co., Ltd.) filled with zirconia beads of 0.3 mm diameter at a volume ratio of 60%, to prepare cyan dispersion 1. A mean particle diameter of cyan pigment obtained was 87 nm.

<Preparation of Black Dispersion 1>

| | |
|---|---|
| Carbon black | 20 weight % |
| Styrene-acrylic acid copolymer (a molecular weight of 7,000, an acid value of 150) | 10 weight % |
| Glycerin | 10 weight % |
| Ion-exchanged water | 60 weight % |

After the above each composition was mixed, the system was dispersed by use of a horizontal-type beads mill (System Zeta Mini, produced by Ashizawa Co., Ltd.) filled with zirconia beads of 0.3 mm diameter at a volume ratio of 60%, to prepare black dispersion 1. A mean particle diameter of black pigment obtained was 75 nm.

<Preparation of Pigment Ink>

<Preparation of Yellow Deep Ink 1>

| | |
|---|---|
| Yellow dispersion 1 | 15 weight % |
| Acryl emulsion (Yodozol AD53, a Tg of 80° C., a mean particle diameter of 80 nm, manufactured by Nippon NCS Co., Ltd.) | 10 weight % |
| Ethylene glycol | 20 weight % |
| Diethylene glycol | 10 weight % |
| Maltitol | 5 weight % |
| Surfactant (Surfinol 465, manufactured by Nisshin Chemical Ind. Co., Ltd.) | 0.1 weight % |
| Ion-exchanged water | 39.9 weight % |

After mixing and stirring the above each composition, the system was filtered through a 1 μm filter to prepare yellow deep ink 1. A mean particle diameter of a pigment included in the ink was 120 nm and a surface tension, γ, of the ink was 36 mN/m.

<Preparation of Yellow Light Ink 1>

| | |
|---|---|
| Yellow dispersion 1 | 3 weight % |
| Acryl emulsion (Yodozol AD53, a Tg of 80° C., a mean particle diameter of 80 nm, manufactured by Nippon NCS Co., Ltd.) | 10 weight % |
| Ethylene glycol | 25 weight % |
| Diethylene glycol | 10 weight % |
| Maltitol | 10 weight % |
| Surfactant (Surfinol 465, manufactured by Nisshin Chemical Ind. Co., Ltd.) | 0.1 weight % |
| Ion-exchanged water | 41.9 weight % |

After mixing and stirring the above each composition, the system was filtered through a 1 μm filter to prepare yellow light ink 1. A mean particle diameter of a pigment included in the ink was 118 nm and a surface tension, γ, of the ink was 37 mN/m.

<Preparation of Magenta Deep Ink 1>

| | |
|---|---|
| Magenta dispersion 1 | 15 weight % |
| Methyl-methacrylate emulsion (Microjel E-1002, a Tg of approx. 60° C., a mean particle diameter of 100 nm, manufactured by Nippon Paint Co., Ltd.) | 10 weight % |
| Ethylene glycol | 20 weight % |
| Diethylene glycol | 10 weight % |
| Maltitol | 5 weight % |
| Surfactant (Surfinol 465, manufactured by Nisshin Chemical Ind. Co., Ltd.) | 0.1 weight % |
| Ion-exchanged water | 39.9 weight % |

After mixing and stirring the above each composition, the system was filtered through a 1 μm filter to prepare magenta deep ink 1. A mean particle diameter of a pigment included in the ink was 113 nm and a surface tension, γ, of the ink was 35 mN/m.

<Preparation of Magenta Light Ink 1>

| | |
|---|---|
| Magenta dispersion 1 | 3 weight % |
| Methyl-methacrylate emulsion (Microjel E-1002, a Tg of approx. 60° C., a mean particle diameter of 100 nm, manufactured by Nippon Paint Co., Ltd.) | 8 weight % |
| Ethylene glycol | 25 weight % |
| Diethylene glycol | 10 weight % |
| Maltitol | 10 weight % |

-continued

| | |
|---|---|
| Surfactant (Surfinol 465, manufactured by Nisshin Chemical Ind. Co., Ltd.) | 0.1 weight % |
| Ion-exchanged water | 43.9 weight % |

After mixing and stirring the above each composition, the system was filtered through a 1 μm filter to prepare magenta light ink 1. A mean particle diameter of a pigment included in the ink was 110 nm and a surface tension, γ, of the ink was 37 mN/m.

<Preparation of Cyan Deep Ink 1>

| | |
|---|---|
| Cyan dispersion 1 | 10 weight % |
| Styrene-acryl emulsion (Yodozol GD86B, a Tg of 60° C., a mean particle diameter of 90 nm, manufactured by Nippon NCS Co., Ltd.) | 10 weight % |
| Ethylene glycol | 20 weight % |
| Diethylene glycol | 10 weight % |
| Maltitol | 5 weight % |
| Surfactant (Surfinol 465, manufactured by Nisshin Chemical Ind. Co., Ltd.) | 0.1 weight % |
| Ion-exchanged water | 44.9 weight % |

After mixing and stirring the above each composition, the system was filtered through a 1 μm filter to prepare cyan deep ink 1. A mean particle diameter of a pigment included in the ink was 95 nm and a surface tension, γ, of the ink was 36 mN/m.

<Preparation of Cyan Light Ink 1>

| | |
|---|---|
| Cyan dispersion 1 | 2 weight % |
| Acryl emulsion (Yodozol GD86B, a Tg of 60° C., a mean particle diameter of 90 nm, manufactured by Nippon NCS Co., Ltd.) | 10 weight % |
| Ethylene glycol | 25 weight % |
| Diethylene glycol | 10 weight % |
| Maltitol | 10 weight % |
| Surfactant (Surfinol 465, manufactured by Nisshin Chemical Ind. Co., Ltd.) | 0.2 weight % |
| Ion-exchanged water | 42.8 weight % |

After mixing and stirring the above each composition, the system was filtered through a 1 μm filter to prepare cyan light ink 1. A mean particle diameter of a pigment included in the ink was 92 nm and a surface tension, γ, of the ink was 33 mN/m.

<Preparation of Black Deep Ink 1>

| | |
|---|---|
| Black dispersion 1 | 10 weight % |
| Acryl emulsion (Yodozol GD86B, a Tg of 60° C., a mean particle diameter of 90 nm, manufactured by Nippon NCS Co., Ltd.) | 8 weight % |
| Ethylene glycol | 20 weight % |
| Diethylene glycol | 10 weight % |
| Maltitol | 5 weight % |
| Surfactant (Surfinol 465, manufactured by Nisshin Chemical Ind. Co., Ltd.) | 0.1 weight % |
| Ion-exchanged water | 46.9 weight % |

After mixing and stirring the above each composition, the system was filtered through a 1 μm filter to prepare black deep ink 1. A mean particle diameter of a pigment included in the ink was 85 nm and a surface tension, γ, of the ink was 35 mN/m.

<Preparation of Black Light Ink 1>

| | |
|---|---|
| Black dispersion 1 | 2 weight % |
| Acryl emulsion (Yodozol GD86B, a Tg of 60° C., a mean particle diameter of 90 nm, manufactured by Nippon NCS Co., Ltd.) | 8 weight % |
| Ethylene glycol | 25 weight % |
| Diethylene glycol | 10 weight % |
| Maltitol | 10 weight % |
| Surfactant (Surfinol 465, manufactured by Nisshin Chemical Ind. Co., Ltd.) | 0.1 weight % |
| Ion-exchanged water | 44.9 weight % |

After mixing and stirring the above each composition, the system was filtered through a 1 μm filter to prepare black light ink 1. A mean particle diameter of a pigment included in the ink was 89 nm and a surface tension, γ, of the ink was 36 mN/m.

<Formation of Inkjet Image and Evaluation>

After each image print was performed on samples 1 to 5 of image receiving media by utilizing an inkjet printer provided with a heating and pressing apparatus of the fixing belt type described in FIG. 2 and above-described each ink, a heating and pressing treatment was performed by a fixing device in the apparatus to obtain each image 1 to 11.

A heating and pressing treatment for the above-described image formation was performed by combining a temperature of a heat roller which hold an endless belt, a nip time and a nip pressure of a heat roller and a pressure roller, as described in Table 1.

Herein, print images were printed including each wedge image of yellow, magenta, cyan and black, and solid chart images of Y, M, C, B, G, R, Bk at a size of 1 cm square.

With respect to above-obtained images 1 to 11, evaluations of gloss, uniformity of gloss and an anti-abrasion property were performed according to the following method.

<Evaluation of Gloss>

With respect to an image of a black solid portion in each sample of images 1 to 11, image clarity (gloss value, C value %) at a reflection of 60 degree and at an optical wedge of 2 mm was measured by use of Image Clarity Meter ICM-1DP (produced by Suga Test Instrument Co., Ltd.). The evaluation was performed according to the following criteria.

A: C value % is not less than 61

B: C value % is from 60 to 61

C: C value % is not more than 50

<Evaluation of Uniformity of Gloss>

A solid chart image of each color was evaluated visually, according to the following criteria.

A: No gloss difference between printed and non-printed portions is observed, and gloss is high.

B: No gloss difference between printed and non-printed portions is observed, however, gloss is somewhat low but in an allowable range.

C: Gloss difference between printed and non-printed portions is significant, which is practically problematic.

<Evaluation of Anti-Abrasion Property>

With respect to each wedge image portion having a reflective density of approximately 1.0 in images formed above, a degree of appearance of contamination when being abraded 10 times with an eraser (MONO, manufactured by Tombo Pencil Co., Ltd.) was evaluated visually according to the following criteria.

A: No contamination is observed in a printed portion of each color

B: Some contamination is observed in a part of a printed portion, however, it is in an allowable range.

C: Contamination was clearly observed in printed portions of all colors.

Each evaluation result obtained above is shown in Table 1.

TABLE 1

| Image No. | Sample No. | Coating solution No. | $T_G$ (° C.) | T (° C.) | t (sec) | $(T - T_G) \times t$ | Support No. | $T_M$ (° C.) | $(T - T_M) \times t$ | Nip pressure (MPa) | Each evaluation results: Gloss | Uniformity of gloss | *1 | Remarks |
|---|---|---|---|---|---|---|---|---|---|---|---|---|---|---|
| 1 | 1 | 3 | 74 | 135 | 0.1 | 6.1 | 1 | 114 | 2.1 | 1.0 | A | A | A | Inv. |
| 2 | 1 | 3 | 74 | 120 | 0.2 | 9.2 | 1 | 114 | 1.2 | 1.0 | A | A | A | Inv. |
| 3 | 2 | 3 | 74 | 130 | 0.2 | 11.2 | 2 | 160 | −6.0 | 1.0 | A | A | A | Inv. |
| 4 | 3 | 4 | 132 | 160 | 0.2 | 5.6 | 2 | 160 | 0 | 1.0 | B | A | A | Inv. |
| 5 | 4 | 5 | 45 | 120 | 0.1 | 7.5 | 1 | 114 | 0.6 | 1.0 | A | A | A | Inv. |
| 6 | 1 | 3 | 74 | 120 | 0.1 | 4.6 | 1 | 114 | 0.6 | 1.0 | B | A | A | Inv. |
| 7 | 1 | 3 | 74 | 135 | 0.1 | 6.1 | 1 | 114 | 2.1 | 1.0 | A | A | A | Inv. |
| 8 | 1 | 3 | 74 | 135 | 0.1 | 6.1 | 1 | 114 | 2.1 | 0.5 | A | A | B | Inv. |
| 9 | 1 | 3 | 74 | 130 | 0.2 | 11.2 | 1 | 114 | 3.2 | 0.5 | B | C | B | Comp. |
| 10 | 5 | 4 | 132 | 160 | 0.2 | 5.6 | 1 | 114 | 9.2 | 0.5 | B | C | B | Comp. |
| 11 | 5 | 4 | 132 | 140 | 0.1 | 0.8 | 1 | 114 | 2.6 | 0.5 | C | A | C | Comp. |

*1; Anti-abration property
Inv.; Invention
Comp.; Comparison

It is clear from Table 1 that images formed, by printing by use of a pigment ink on an image receiving medium comprised of a constitution of the invention and performing a heating and pressing treatment under heating conditions defined by the invention, exhibit excellent gloss and gloss uniformity as well as a favorable anti-abrasion property, in comparison to a comparative example.

[Effect of the Invention]

The present invention has been able to provide an inkjet recording method and an inkjet recording apparatus, which are excellent in gloss uniformity as well as favorable in an anti-abrasion property.

What is claimed is:

1. An inkjet recording method comprising:

ejecting ink containing pigment, water and an organic solvent onto an image receiving medium, wherein the image receiving medium comprises;

a support member having a non-solvent-permeable resin layer, and an ink image receiving layer, which is provided on the support member, having laminated layers of a solvent absorbing layer containing inorganic fine particles and a binder, and a surface portion layer containing resin fine particles, an inorganic pigment and a binder, wherein a weight ratio of the inorganic pigment to the resin fine particles (inorganic pigment/resin fine particles) is from 3/7 to 7/3; and conducting a heating and pressing treatment onto the image receiving medium by a heating and pressing device, wherein the heating and pressing treatment satisfies conditions of following expressions (1) and (2) at the same time, $$(T-T_G)\times t>2 \quad \text{expression (1)}$$

$$(T-T_M)\times t>3 \quad \text{expression (2)}$$

wherein, T represents a surface temperature (° C.) of a member of the heating and pressing device, which is arranged on the ink image receiving layer side of at the position where heating and pressing treatment is conducted; $T_G$ represents a glass transition temperature of the resin fine particles (° C.); t represents a processing time (second) of the heating and pressing treatment; and $T_M$ represents a melting temperature (° C.) of the non-solvent-permeable resin layer.

2. The inkjet recording method of claim 1, wherein the heating and pressing treatment satisfies conditions of the following expressions (3) and (4) at the same time, $$(T-T_G)\times t>6 \quad \text{Expression (3)}$$

$$(T-T_M)\times t>3 \quad \text{Expression (4)}$$

wherein, T, $T_G$, $T_M$, and t represent the same meanings as in the expressions (1) and (2).

3. The inkjet recording method of claim 1, wherein a thickness of the surface portion layer is from 3 to 10 $\mu$m.

4. The inkjet recording method of claim 1, wherein the total thickness of the solvent absorbing layer is from 25 to 40 $\mu$m.

5. The inkjet recording method of claim 1, wherein a porosity of the ink image receiving layer is from 30 to 70%.

6. The inkjet recording method of claim 1, wherein the support member is comprised of paper and the non-solvent-permeable resin layer, and a melting point of the non-solvent-permeable resin layer is from 100 to 180° C.

7. The inkjet recording method of claim 1, wherein at least one kind of resin included in the non-solvent-permeable resin layer is polyolefin resin.

8. The inkjet recording method of claim 1, wherein a glass transition temperature of the resin fine particles is from 50 to 180° C.

9. The inkjet recording method of claim 1, wherein a mean particle diameter of the resin fine particles is from 50 to 500 nm.

10. The inkjet recording method of claim 1, wherein a pressure of the heating and pressing device is not less than 0.6 M Pa.

11. An inkjet recording apparatus comprising:

a recording head for ejecting ink containing pigment, water and an organic solvent onto an image receiving medium, wherein the image receiving medium comprises;

a support member having a non-solvent-permeable resin layer, and an ink image receiving layer, which is provided on the support member, having laminated layers of a solvent absorbing layer containing inorganic fine particles and a binder, and a surface portion layer containing resin fine particles, an inorganic pigment and a binder, wherein a weight ratio of the inorganic pigment to the resin fine particles (inoragnic pigment/resin fine particles) is from 3/7 to 7/3; and a heating and pressing device for conducting a heating and pressing treatment onto the image receiving medium, and the heating and pressing device comprises a heat roller and a pressure roller for forming a nip where the image recording medium is pressed, wherein the heating and pressing treatment satisfies conditions of following expressions (1) and (2) at the same time, $$(T-T_G)\times t>2 \quad \text{expression (1)}$$

$$(T-T_M)\times t<3 \quad \text{expression (2)}$$

wherein, T represents a surface temperature (° C.) of a member of the heating and pressing device, which is arranged on the ink image receiving layer side of at the position where heating and pressing treatment is conducted; $T_G$ represents a glass transition temperature of said resin fine particles (° C.); t represents a processing time (second) of the heating and pressing treatment; and $T_M$ represents a melting temperature (° C.) of the non-solvent-permeable resin layer.

12. The inkjet recording apparatus of claim 11, wherein the heating and pressing treatment satisfies conditions of the following expressions (3) and (4) at the same time, $$(T-T_G)\times t>6 \quad \text{expression (3)}$$

$$(T-T_M)\times t<3 \quad \text{expression (4)}$$

wherein, T, $T_G$, $T_M$, and t represent the same meanings as in the expressions (1) and (2).

13. The inkjet recording apparatus of claim 11, further comprising an endless belt which houses the heat roller.

14. The inkjet recording apparatus of claim 11, wherein the surface of the heat roller is covered with silicone resin.

15. The inkjet recording apparatus of claim 13, wherein the surface of the endless belt is covered with silicone resin.

16. The inkjet recording apparatus of claim 11, wherein the heat roller has a surface roughness of not more than 80 nm, and is brought in contact with the ink image receiving layer side of an image receiving medium.

17. The inkjet recording apparatus of claim 13, wherein the endless belt has a surface roughness of not more than 80 nm, and is brought in contact with the ink image receiving layer side of the image receiving medium.

* * * * *